US011192012B2

(12) United States Patent
Lupfer et al.

(10) Patent No.: US 11,192,012 B2
(45) Date of Patent: Dec. 7, 2021

(54) SPORT APPARATUS WITH INTEGRATED SENSORS

(71) Applicant: Kinetek Sports, San Diego, CA (US)

(72) Inventors: Thomas H. Lupfer, San Diego, CA (US); Patrick M. Steusloff, Del Mar, CA (US); Michael A. Kurtz, San Diego, CA (US)

(73) Assignee: KINETEK SPORTS, San Diego, CA (US)

( * ) Notice: Subject to any disclaimer, the term of this patent is extended or adjusted under 35 U.S.C. 154(b) by 0 days.

(21) Appl. No.: 16/878,441

(22) Filed: May 19, 2020

(65) Prior Publication Data

US 2020/0368600 A1 Nov. 26, 2020

Related U.S. Application Data

(60) Provisional application No. 62/851,482, filed on May 22, 2019.

(51) Int. Cl.

| | |
|---|---|
| ***A63B 69/36*** | (2006.01) |
| ***A63B 60/46*** | (2015.01) |
| ***A63B 24/00*** | (2006.01) |

(52) U.S. Cl.

CPC ..... *A63B 69/3614* (2013.01); *A63B 24/0006* (2013.01); *A63B 60/46* (2015.10); *A63B 2220/53* (2013.01)

(58) Field of Classification Search

CPC . A63B 69/3614; A63B 60/46; A63B 24/0006; A63B 2220/53; A63B 24/0003; A63B 71/0622; A63B 2220/74; A63B 2220/12; A63B 2220/44; A63B 2220/34; A63B 2220/58; A63B 2071/0625; A63B 2071/0655; A63B 2225/74; A63B 60/52; A63B 69/3632; A63B 53/10; A63B 2220/803; A63B 2220/833; A63B 2225/50

See application file for complete search history.

(56) References Cited

U.S. PATENT DOCUMENTS

| | | | | |
|---|---|---|---|---|
| 5,082,283 | A | 1/1992 | Conley | |
| 5,184,826 | A | 2/1993 | Hall, Jr. | |
| 5,419,562 | A | 5/1995 | Cromarty | |
| 5,435,561 | A * | 7/1995 | Conley | G01P 15/0888 473/223 |
| 5,638,300 | A * | 6/1997 | Johnson | A63B 24/0003 473/223 |
| 6,012,988 | A | 1/2000 | Burke | |
| 6,196,932 | B1 | 3/2001 | Marsh et al. | |
| 6,402,634 | B2 | 6/2002 | Lee et al. | |
| 6,413,167 | B1 | 7/2002 | Burke | |
| 6,441,745 | B1 | 8/2002 | Gates | |

(Continued)

*Primary Examiner* — Michael D Dennis

(74) *Attorney, Agent, or Firm* — Knobbe, Martens, Olson & Bear LLP

(57) ABSTRACT

A sport apparatus comprising a shaft, wherein the shaft comprises a notch fitting and a sensor housing. The sensor housing comprises an alignment rib fitting, printed circuit board, rechargeable battery, one or more motion sensors, a transceiver, an inductive charging coil, among other necessary elements for the sport apparatus as described herein. A portion of the sensor housing resides within the shaft, wherein the alignment rib of the sensor housing mates with a notch or other locking mechanism of the shaft.

18 Claims, 13 Drawing Sheets

(56) References Cited

U.S. PATENT DOCUMENTS 6,607,450 B1 8/2003 Hackman
6,649,905 B2 11/2003 Grenlund
6,753,778 B2 6/2004 Kruger
7,800,480 B1 9/2010 Joseph et al.
7,801,575 B1 9/2010 Balardeta et al.
7,804,404 B1 9/2010 Balardeta et al.
7,831,212 B1 11/2010 Balardeta et al.
7,878,921 B2 * 2/2011 Bennett ..... A63B 53/0466 473/307
7,931,544 B2 4/2011 Gill
8,109,816 B1 2/2012 Grober
8,137,208 B2 3/2012 Ahem et al.
8,348,779 B2 1/2013 Kim
8,500,570 B2 8/2013 Stites et al.
8,939,136 B2 * 1/2015 Gaus ..... A63H 33/18 124/5
2002/0123386 A1 9/2002 Perlmutter
2005/0288119 A1 * 12/2005 Wang ..... A63B 71/06 473/223
2007/0243947 A1 10/2007 Cheng
2009/0163287 A1 6/2009 Vald'Via et al.
2009/0233735 A1 * 9/2009 Savarese ..... G08B 13/1481 473/407
2010/0093457 A1 4/2010 Ahern et al.
2011/0054782 A1 3/2011 Kaahui
2011/0230277 A1 * 9/2011 Choi ..... A63B 53/14 473/296
2012/0088544 A1 * 4/2012 Bentley ..... A63F 13/213 455/556.1
2013/0065703 A1 3/2013 Rose
2013/0095939 A1 4/2013 Meadows et al.
2013/0203517 A1 8/2013 Bolane et al.
2014/0200092 A1 * 7/2014 Parke ..... G01C 21/16 473/223
2015/0362331 A1 * 12/2015 Sanchez ..... A63B 60/16 702/153
2016/0129306 A1 * 5/2016 Ishikawa ..... A61B 5/6895 473/223
2016/0166902 A1 * 6/2016 Day ..... A63B 60/16 473/223
2016/0303443 A1 * 10/2016 Boggs ..... A63B 53/047

* cited by examiner

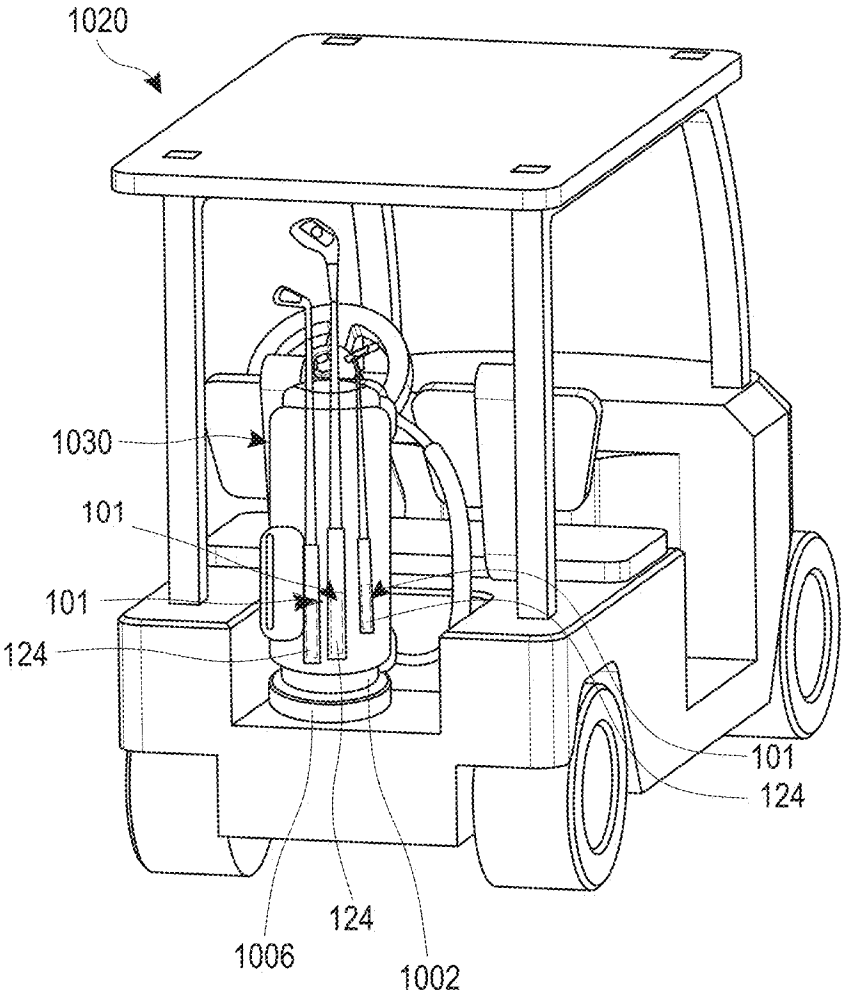
FIG. 5A
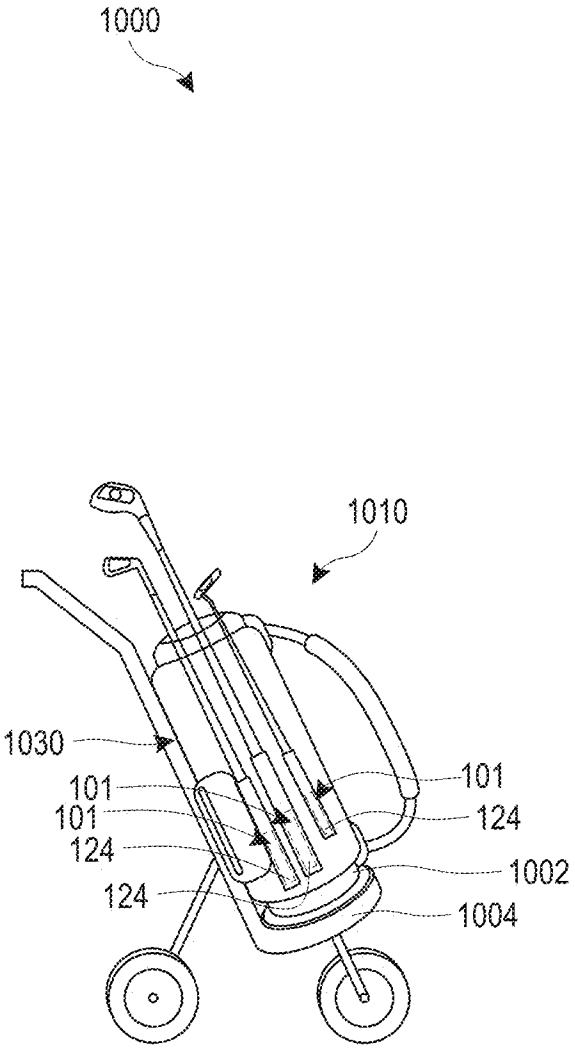

SPORT APPARATUS WITH INTEGRATED SENSORS

CROSS REFERENCE TO RELATED APPLICATIONS

This application claims priority to U.S. Provisional Patent Application No. 62/851,482 filed May 22, 2019 entitled "SPORT APPARATUS WITH INTEGRATED SENSORS", the disclosure of which is incorporated herein by reference in its entirety.

FIELD OF THE INVENTION

The disclosed subject matter generally relates to the field of sporting equipment. More specifically towards a sport apparatus with an integrated sensor system along with methods of manufacturing and calibrating the sport apparatus with the integrated sensor system.

BACKGROUND

Motion tracking and/or capture technology aims to record and/or track the actions of a user or device with various sensors. Further, this technology may attach to a sport apparatus, such as a golf club, to record and/or track the movements of the sport apparatus. However, motion capture technology that merely attaches to the sport apparatus may fail to accurately measure and/or report the motion of the sport apparatus, such as a golf swing. Moreover, when the motion capture technology is not integrated and/or embedded into the sport apparatus, the sport apparatus may not have the appearance, feel, and/or characteristics of a traditional sport apparatus, such as a standard golf club.

Further, the motion capture technology may require additional setup that is not easily portable, adaptable and/or mobile. Therefore, tracking and/or capturing the motion of the sport apparatus via existing motion capture technology in any sports environment at any time has several downsides.

SUMMARY

For purposes of summarizing, certain aspects, advantages, and novel features have been described herein. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested herein.

The present disclosure provides a sport apparatus, for example, a golf club, with an integrated sensor system to measure a swing of an athlete using the sport apparatus. The present disclosure also provides methods of manufacturing, calibrating and integrating the sport apparatus with the sensor system.

Further, the present disclosure may provide a sport apparatus, such as a golf club, with integrated sensors and associated electronics that function nearly identically to a sport apparatus that does not have integrated sensors and associated electronics. The present disclosure may also provide a sport apparatus which uses stock grips, for example, wrap grips and/or rubber grips. In this way an athlete may not be able to distinguish the two types of sport apparatus by feel, swing performance, weight, among other tactile responses.

Additionally, the present disclosure may provide a sport apparatus with an integrated sensor system, such as a golf club, that does not require modification of the grip or head, such as a golf club head, prior to or after assembly.

Moreover, the present disclosure may provide a method for manufacturing a sport apparatus with an integrated sensor system that only requires minor modification of a standard shaft at the grip end of the sport apparatus prior to installing the grip. In one embodiment, the integrated sensor system is powered by a battery.

Some of the features of the present disclosure have been broadly outlined such that the detailed description thereof may be better understood. There are additional features of the present disclosure that are described herein and which also form the subject matter of the claims appended hereto. The features listed herein and other features, aspects, and advantages of the present disclosure will become better understood with reference to the description and appended claims.

The details of one or more variations of the subject matter described herein are set forth in the accompanying drawings and the description below. Other features and advantages of the subject matter described herein will be apparent from the description and drawings, and from the claims. The disclosed subject matter is not, however, limited to any particular embodiment disclosed.

BRIEF DESCRIPTION OF THE DRAWINGS

The accompanying drawings, which are incorporated in and constitute a part of this specification, show certain aspects of the subject matter disclosed herein and, together with the description, help explain some of the principles associated with the disclosed implementations as provided below.

FIG. 5A illustrates an example perspective view of the integrated sensor system assembled into the example golf clubs that are wirelessly charging via various charging pads and/or stations according to various embodiments of the present disclosure.

Figure 1:
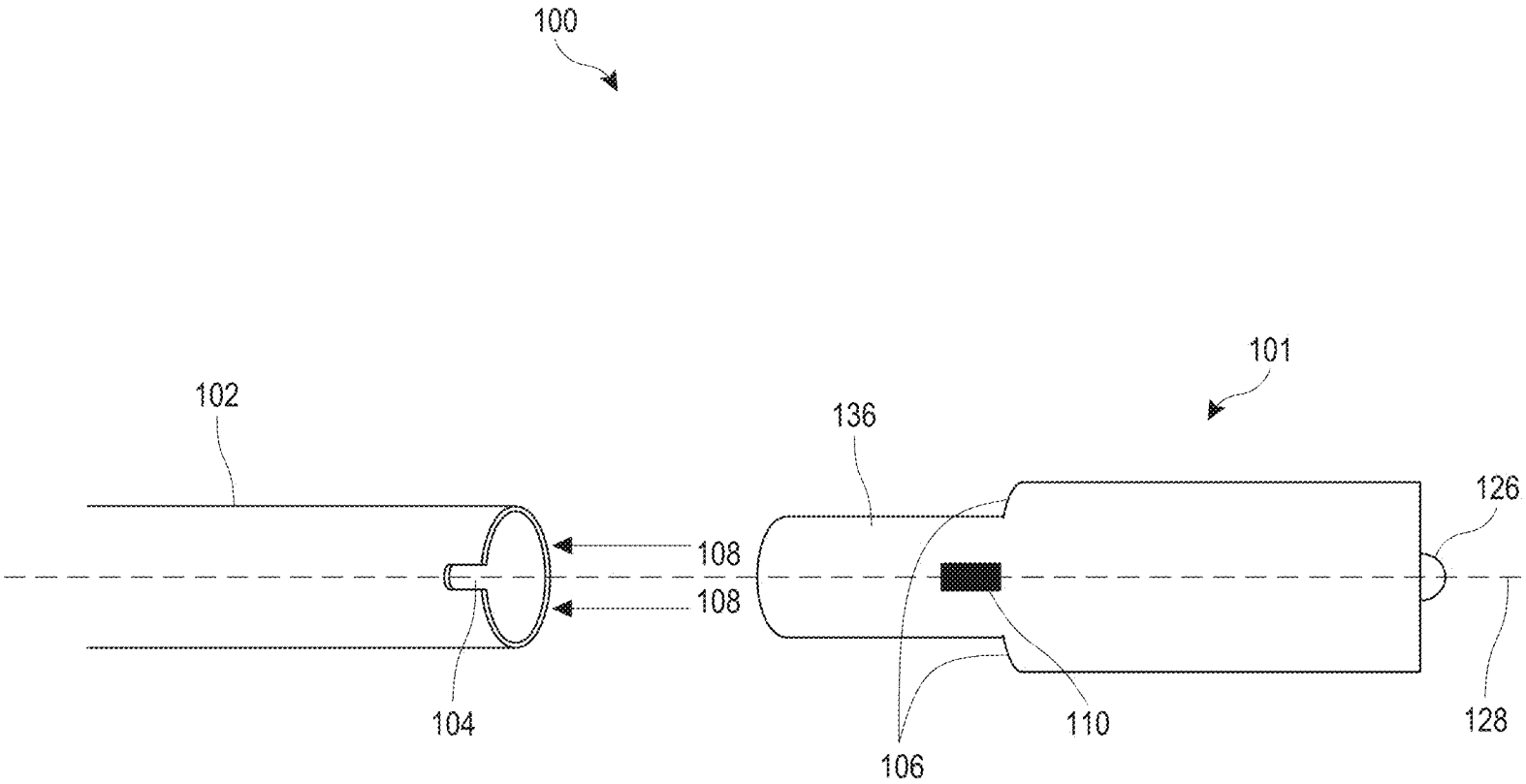
FIG. 1 illustrates an example side perspective view of a sensor system being installed into the grip end of a golf club shaft according to various embodiments of the present disclosure.

The figures may not be to scale in absolute or comparative terms and are intended to be exemplary. The relative placement of features and elements may have been modified for the purpose of illustrative clarity. Where practical, the same or similar reference numbers denote the same or similar or equivalent structures, features, aspects, or elements, in accordance with one or more embodiments.

DETAILED DESCRIPTION

In the following, numerous specific details are set forth to provide a thorough description of various embodiments. Certain embodiments may be practiced without these specific details or with some variations in detail. In some instances, certain features are described in less detail so as not to obscure other aspects. The level of detail associated with each of the elements or features should not be construed to qualify the novelty or importance of one feature over the others.

In some embodiments, a system can comprise, not comprise, consist essentially of, or consist of any number of features as disclosed herein.

In some embodiments, a method can comprise, not comprise, consist essentially of, or consist of any number of features as disclosed herein.

Overview

There are several challenges that need to be solved to provide a sport apparatus that may be used during the actual sport, while accurately recording and/or reporting information for subsequent analysis. Some of these challenges as described herein focus on golf clubs, though the same or similar challenges overcome by the disclosed technology are applicable to other sport apparatuses, including baseball bats, softball bats, cricket bats, billiard cues, polo mallets, hockey sticks, lacrosse sticks, fishing rods, racquetball racquets, and tennis rackets.

To minimize development and production costs, it is desirable that the design of the disclosed technology employ stock parts, e.g., golf club components such as grips, heads, and shafts, in their current form to the fullest extent possible. That way a sport apparatus without the sensor system, such as a golf club, appears and handles nearly identical to a sport apparatus with the sensor system, such as a golf club with the integrated sensor system as described herein. Further, the material supply chain should be unaffected.

Accordingly, embodiments of the invention relate to a sport apparatus comprising an integrated sensor system that does not significantly change the weight or the balance of the sport apparatus. In one embodiment, the system is configured so that data transmission by Bluetooth (e.g., Bluetooth low energy (BLE)), GPS, cellular modem and/or comparable radio is not be impeded. For example, some golf clubs may use steel or graphite shafts, or grips that could act to impede data transmission.

In one embodiment the sensor system allows customization of sport apparatus length, for example altering the length of a golf club shaft. For example, in eighth-inch, quarter-inch, half-inch, or inch increments. The integration of the sensor system into the sport apparatus allows for any standard sized grip to be utilized with the sport apparatus. In some embodiments, the sensor system provides accurate sensor axis orientation relative to the sport apparatus shaft and face.

In one embodiment, the sensor system includes a power source to power the electronics without encumbering the player and/or athlete during use. Additionally or alternatively to long battery life, convenient charging may be utilized to charge the batteries of the sensor system.

Since many sports are played during inclement weather, the sport apparatus with integrated sensor system and other electronics may be water resistant and/or waterproof in some embodiments.

Exemplary System

Many aspects of the invention can be better understood with the references made to the drawings described herein. The components in the drawings are not necessarily drawn to scale. Instead, emphasis is placed upon clearly illustrating the components of the present invention. Moreover, like reference numerals designate corresponding parts through the several views in the drawings.

One embodiment is a sensor system that is designed to mate with the shaft of a sport apparatus. The sensor system may be enclosed into a sensor housing that may be made of plastic (e.g., polycarbonate-ABS), metal (e.g., steel, aluminum, among other like metals), graphite, wood, or some combination of these materials. The cylindrical sensor housing should mirror the diameter and/or enlarging diameter of the shaft of the sports apparatus so that it can fit inside the shaft. Embedded in the cylindrical sensor housing is a printed circuit board (PCB) comprising one or more motion sensors, such as microelectromechanical structures (MEMS) sensors and/or solid-state sensors, a microcontroller (MCU), a transceiver and/or receiver, such as a Bluetooth radio, and a battery. The circuit board contains other electronics to control power and store sensor data (e.g., data related to the swing of the athlete) for analysis and transmission. In this embodiment, the cylindrical sensor housing is made with a taper that matches the taper at the grip end of the shaft of the sport apparatus, for example, the shaft of a golf club. In certain embodiments, the pitch of this taper is <0.2 degrees. It must be appreciated, however, that sport apparatuses with non-cylindrical shafts will necessitate non-cylindrical bodies that match the inner shape of the shaft to embed the electronic components. The cylindrical or corresponding non-cylindrical body is also referred to herein as a sensor housing.

According to certain embodiments related to a golf club, the sensor housing has a first end with a diameter that allows it to be fitted inside the walls of the grip end of the golf club shaft. The housing also has a second end with a diameter that enlarges to match the outer diameter of the shaft. In certain embodiments, this enlargement is by way of a step in the housing that forms a rim or lip that limits the depth of insertion of the housing into the shaft of the golf club.

Referring now to FIG. 1, a side perspective view 100 of the grip end of a golf club shaft 102 is shown with a sensor system 101 according to various embodiments of the current disclosure. A stock grip (not shown) can be slid over the sensor system 101 and the shaft 102 along a line 128 to complete the assembly. The shaft 102 includes an alignment notch 104 that mates with an alignment rib 110 on the exterior of the sensor housing 136. As the sensor housing 136 is inserted 108 into the shaft 102, the alignment rib 110 mates with the alignment notch 104 thereby restricting rotational movement of the integrated sensor system 101 about the longitudinal axis of the shaft 102. In addition, a shoulder 106 has a larger circumference than the shaft 102 and thereby prevents the integrated sensor system 101 from being inserted too far into the shaft 102. At the distal end of the integrated sensor system 101 is a LED 126 that may illuminate out of the drain hole of the associated grip in order to indicate the status of the integrated sensor system 101 to a user.

By inserting the sensor housing 136 into the shaft 102 of the sport apparatus, a secure fit may be achieved. To account for the slight variation in shaft 102 diameters, very thin sleeves of plastic material (not shown) may be applied to the sensor housing 136 portion that is inserted into the shaft 102. This reduces the movement of the sensor housing 136 relative to the shaft 102. In particular embodiments, an adhesive is used to secure the sensor housing 136 to and within the shaft 102. The adhesive may provide additional rigidity to the final assembled sport apparatus by encompassing any unoccupied volume between the shaft 102 and the sensor housing 136. Further, the sensor housing 136 seams may be completely sealed with adhesive, such as glue and/or sonic welding. Thus, the integrated sensor system 101 becomes waterproof and/or water resistant. In embodiments in which the sport apparatus is a golf club, one skilled in the art will appreciate this waterproofing/resistance method as drain holes, which are common in the grip of golf clubs, allow entry of water.

Custom fitted golf club lengths are often specified in quarter-inch increments. Prior to insertion of the sensor system 101, a shaft 102 can be cut to the desired length. The sensor system 101 is then inserted and affixed to the shaft 102. Likewise, the position of the shoulder 106 on the sensor system 101 may be used to control the overall length of the golf club and can be done so in set increments, such as quarter-inch increments. For longer clubs, the shoulder 106 is moved closer to the head of the club, for shorter clubs the shoulder 106 is moved closer to the grip of the club.

In addition or alternatively to the shoulder 106, the alignment rib 110 may have sections that can be selectively removed to set the length of the sport apparatus. For example, the alignment rib 110 may have sections separated at set increments, such as quarter-inch increments. By removing one of the sections in the alignment rib 110 (thereby making the total length of the alignment rib 110 shorter), the cylinder 136 is allowed to slide further into the shaft 102 of the sport apparatus before the end of the alignment rib 110 mates with the end of the alignment notch 104 in the shaft 102. Moreover, each section of the alignment rib 110 may be barbed or otherwise have a protrusion. The barbs or protrusions restrict and/or prevent removal of the sensor housing 136 from the shaft 102 of the sport apparatus. Likewise, the notch 104 in the shaft 102 may have additional portions removed to mate with the barb or protrusion of the alignment rib 110, thereby further securing the sensor housing 136 to the shaft 102 of the sport apparatus.

Figure 2A:
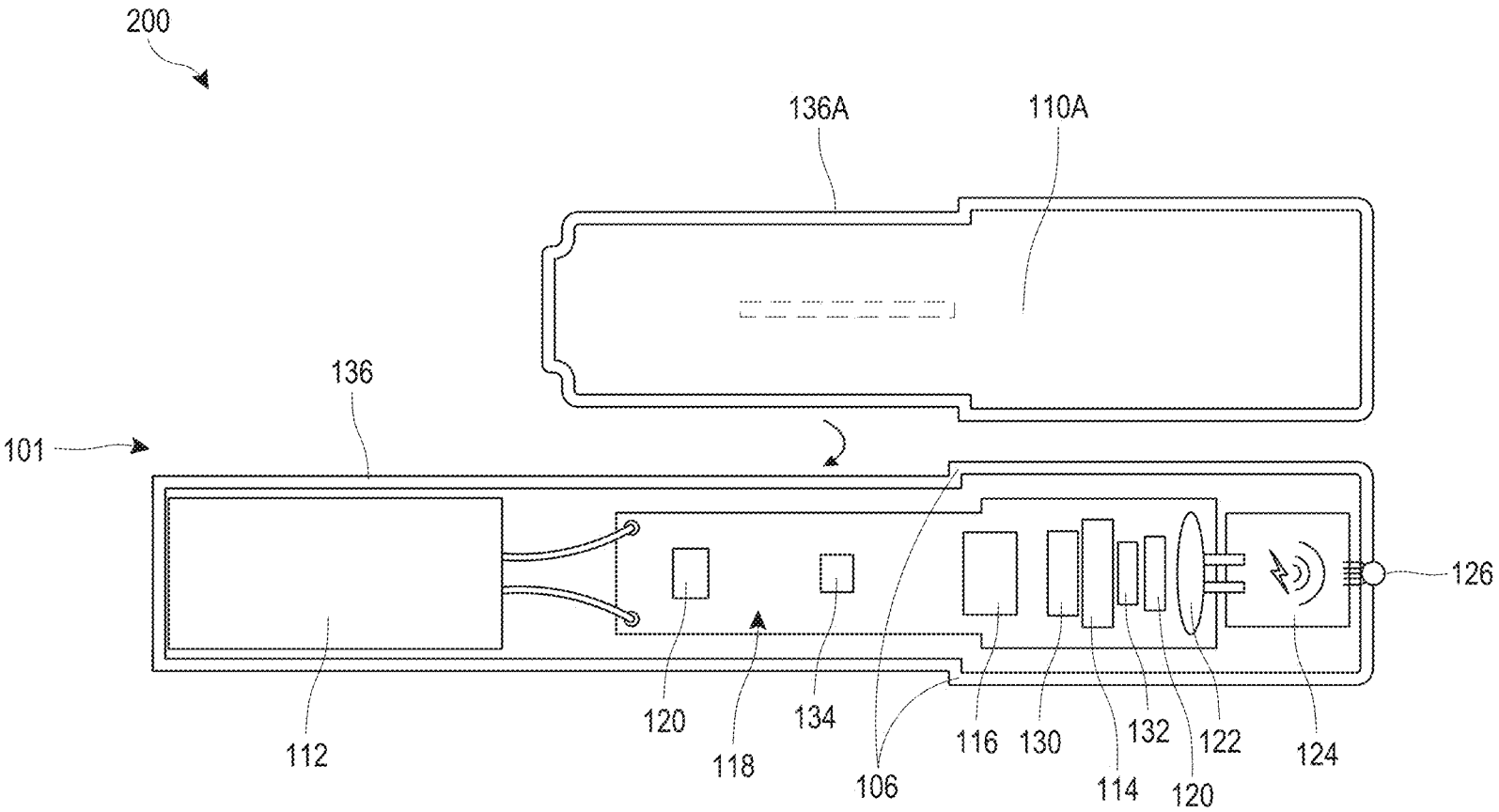
FIG. 2A illustrates an example side view of an embodiment of the sensor system with a partial sensor housing.

FIG. 2A shows the sensor system 101 of FIG. 1 as opened up to reveal the various electronic components of the sensor system 101. The components may include, depending on implementation, the rechargeable battery 112, microcontroller 116 with memory, antenna 122 (e.g., Bluetooth radio), MEMS and/or solid-state sensors 114 (e.g., multi-axis accelerometer, gyroscope, and magnetometer also known as magnetic, angular rate, and gravity (MARG) sensors), barometer 130, feedback device 134 (e.g., a haptic feedback motor and/or audio feedback device), global positioning system (GPS) receiver with antenna 120, cellular modem 132, inductive charging coil 124, and light-emitting diode (LED) 126, are encapsulated within the sensor housing 136.

The barometer 130 may provide air density information. One skilled in the art may appreciate that the barometer 130 may be valuable in determining how far a sport object, such as a golf ball, travels through the air for a given amount of swing force and/or swing path from the athlete and/or impact energy via the sport apparatus. The GPS 120 may eliminate the need to use a paired smart device (e.g., phone and/or tablet) GPS for shot tracking of the sport apparatus, such as a golf club. This is particularly helpful as players and/or athletes often do not carry a smart device when they are playing, nor may the various sport apparel of the player and/or athlete allow for use of pockets to carry such a smart device. The MARG sensors 114 may provide the absolute direction, orientation and position in reference to the motion and coordinate system of the sport apparatus.

The haptic feedback motor 134 may provide feedback based on the player and/or athletes sense of touch (e.g., pressure and/or contact of the sport apparatus). The audio feedback device 134 may provide status sounds (e.g., chirps, buzzes, rings or other like audio indicators) to indicate status of the integrated sensor system 101 and/or provide feedback based on the most recent motion of the sport apparatus. The LED 126 may illuminate out of the drain hole of the grip in order to indicate the status of the integrated sensor system 101. The inductive charging coil 124 is placed at the end opposite of the sensor system 101 furthest away from the shaft 102 to allow for sufficient and convenient charging, as described in more detail herein. After the sensor housing 136 is placed at least partially into the shaft 102 of the sport apparatus, a standard grip is installed over the shaft 102 and sensor housing 136.

The sensor housing 136 contains a printed circuit board (PCB) 118 that is manufactured with precise placement of the sensors 114. The shaft 102 may be modified to be shorter and to have a reference notch 104 cut into its wall at the grip end, to mate with the alignment rib 110 described herein. The assembled PCB 118 is precisely placed in the sensor housing 136 such that the sensor housing 136 alignment rib 110 can be used to accurately reference the orientation of the sensor axes via the sensors 114. For example, the head of a golf club is mounted in an orientation that accurately aligns with the notch 104 in the shaft 102. This allows the sensor axes to be aligned with the shaft 102 length and the face of the golf club.

The precise alignment of the sensor axes to that of the face of the golf club allows for more precise and accurate measurements, which were previously not possible. With aligned sensors 114 in the appropriate orientation, more accurate lean, swing path, and closure rate (e.g., rotational velocity) measurements, among others, are capable with the apparatus disclosed herein.

After installation of the sensor housing 136, a standard grip may be installed over the sensor housing 136 and the shaft 102. The resulting sport apparatus appears identical or nearly identical to another like sport apparatus that does not have the sensor system 101.

In certain embodiments, a method of manufacturing a sport apparatus with integrated sensor system 101 includes the step of removing a length of the shaft 102. Removing a length from the stock shaft 102 reduces not only the length of the shaft 102, but also its weight. This offsets the weight of the sensor system 101. For example, this makes a sensor system-fitted golf club feel nearly identical to a golf club without the sensor system 101.

Since many golf shafts are made from steel, the Bluetooth radio antenna 122, cellular modem 132, and GPS antenna 120 should not be enclosed in the steel shaft 102 since it would impede radio wave transmission. By making the body of the sensor housing 136 from plastic and/or epoxy and positioning the Bluetooth radio antenna 122, cellular modem 132, and GPS antenna 120, away from the steel shaft 102, radio wave transmission is at most slightly degraded, if at all.

The plastic material chosen for the sensor housing 136 (e.g., PC-ABS) is rugged enough to withstand the forces the sensor housing 136 will incur without fracturing or bending.

In order to eliminate the need for a charging connector exposed to the outside of the golf club, which can lead to reduced durability and issues related to water resistance, an inductive coil 124 is used to charge the battery 112. The inductive coil 124 is at the far distal grip end of the sensor housing 136 (that is, the end opposite of the sport apparatus e.g., golf club head) so it can be placed in close enough proximity to a powered charging coil, station and/or charging pad. The inductive coil 124 is positioned far enough away from the Bluetooth radio antenna 122, GPS antenna 120, and cellular modem 132 as to not interfere with the Bluetooth radio, GPS and/or cellular modem transmissions. An inductive charging pad or cap may be used by the sport apparatus, e.g., golf club, owner to charge the battery 112.

In certain embodiments, the inductive charging pad is integrated into the base of a golf bag. The golf bag has a separate battery source to power the inductive charging pad, has a cable for connecting the inductive charging pad to a power outlet, or both. Accordingly, the rechargeable battery 112 of each golf club is charged via the inductive charging pad of the golf bag when the golf clubs are placed in the golf bag.

While rechargeable batteries 112 are described in certain embodiments, other embodiments herein may use primary or non-rechargeable batteries. In these embodiments, the battery 112 may have a sufficient lifespan to not require replacement during the useful life of the sport apparatus, or may have a method of accessing and replacing the battery 112.

In certain embodiments, an indicator LED 126 is visible through the standard drain hole in the grip.

Particular embodiments of the current disclosure also include an ON/OFF/pin restart switch accessible through the drain hole at the grip end of the shaft 102 of a golf club (e.g., at the end of the sensor system 101 near and/or at the indicator LED 126). This multipurpose switch can turn the integrated sensor system 101 on and off, as well as restart or reset the device if the MCU "hangs" or becomes unresponsive. The multipurpose switch may also be used as an ON/OFF switch to preserve battery power when the sport apparatus is stored or shipped. A thin, narrow object or pin may be inserted through an opening to depress a button that turns the unit on or off, or if depressed for at least a set period of time, restarts or resets the device. Other embodiments place the multipurpose switch in a location other than the drain hole, particularly if the indicator LED 126 is located at or visible through the standard drain hole. In yet other embodiments, the indicator LED 126 itself is a depressible button that extends through or is located at or near the drain hole at the grip end of the shaft 102.

In addition to the sensor system 101 as described herein, other sensors and electronic components may be included and embedded within the sensor housing 136. For example, Global Navigation Satellite System (GNSS) circuitry 120 may be included to track the position of the sport apparatus. Electronic memory, cellular modems 132 and/or other communication circuitry, and other processors may be integrated into the sensor housing 136 and the corresponding sport apparatus such as a golf club. For example, by including select components in different golf clubs, a set of golf clubs may be able to distribute computing, storage, and processing power to collectively create a sensor system 101 for measuring, processing, storing, and distributing measured swing data of the sport apparatus. For example, a first club may have the components shown in FIG. 1, plus electronic nonvolatile memory. A second club may have the components shown in FIG. 1, plus an additional cellular modem 132. A third club may have the components shown in FIG. 1, plus an additional processor and random access memory. A fourth club may have the components shown in FIG. 1, plus GNSS circuitry. When the four clubs operate together, for example, by communicating via their Bluetooth radios 122, measurements tracked by each club may be passed to other clubs for processing swing data, associating that data with geographic coordinates, storage in nonvolatile memory, and distribution to remote servers via the cellular modem.

While a golf club is described herein as an exemplary sport apparatus, other sport apparatus are contemplated by the current disclosure to include the integrated sensor system 101, including without limitation baseball, cricket and softball bats, tennis and racquetball rackets, fishing rods, polo mallets, billiard cues, and hockey and lacrosse sticks.

Exemplary System Enclosures

Figure 2B:
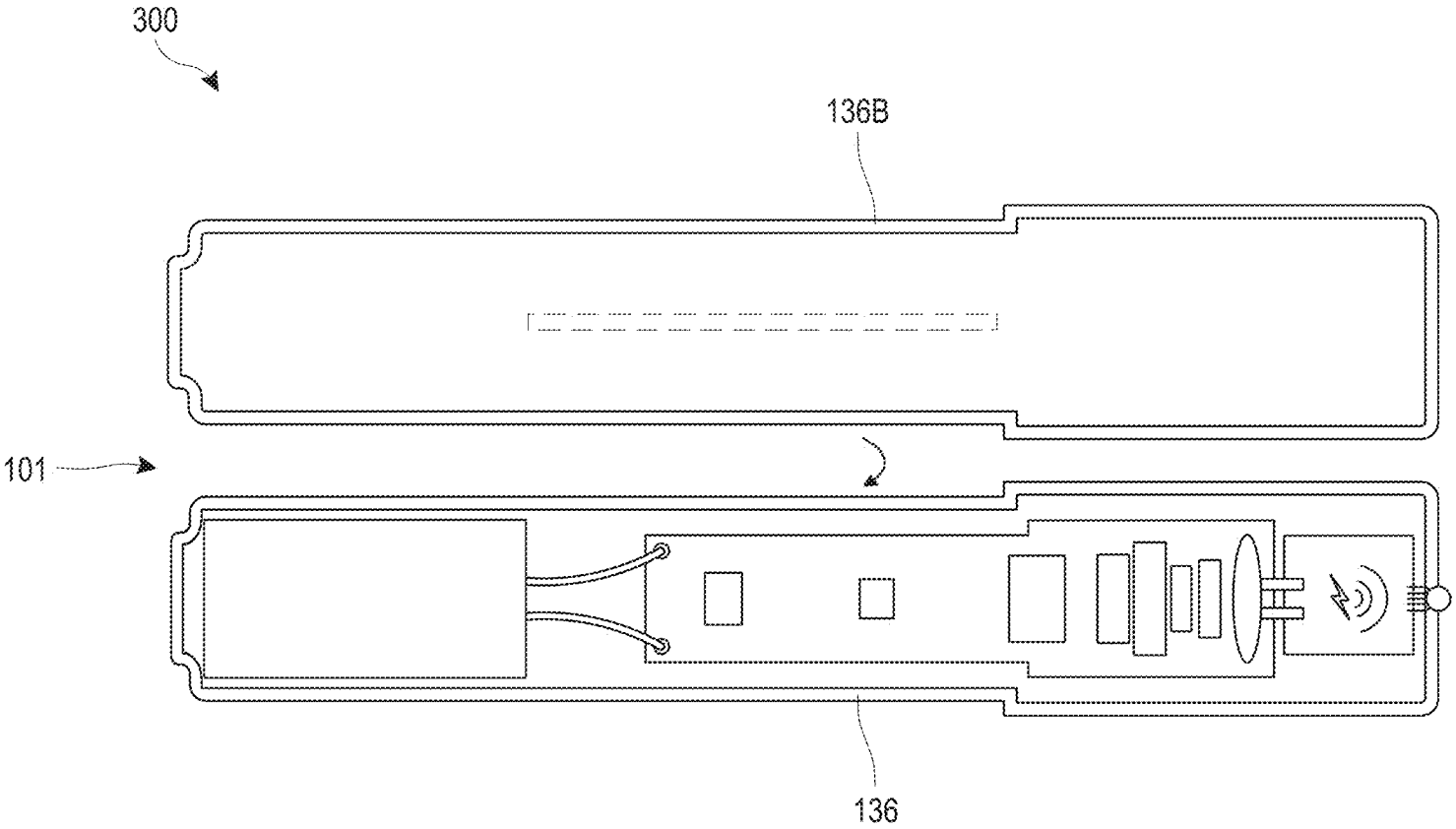
FIG. 2B illustrates an example side view of an embodiment of the sensor system with a full sensor housing.
Figure 2C:
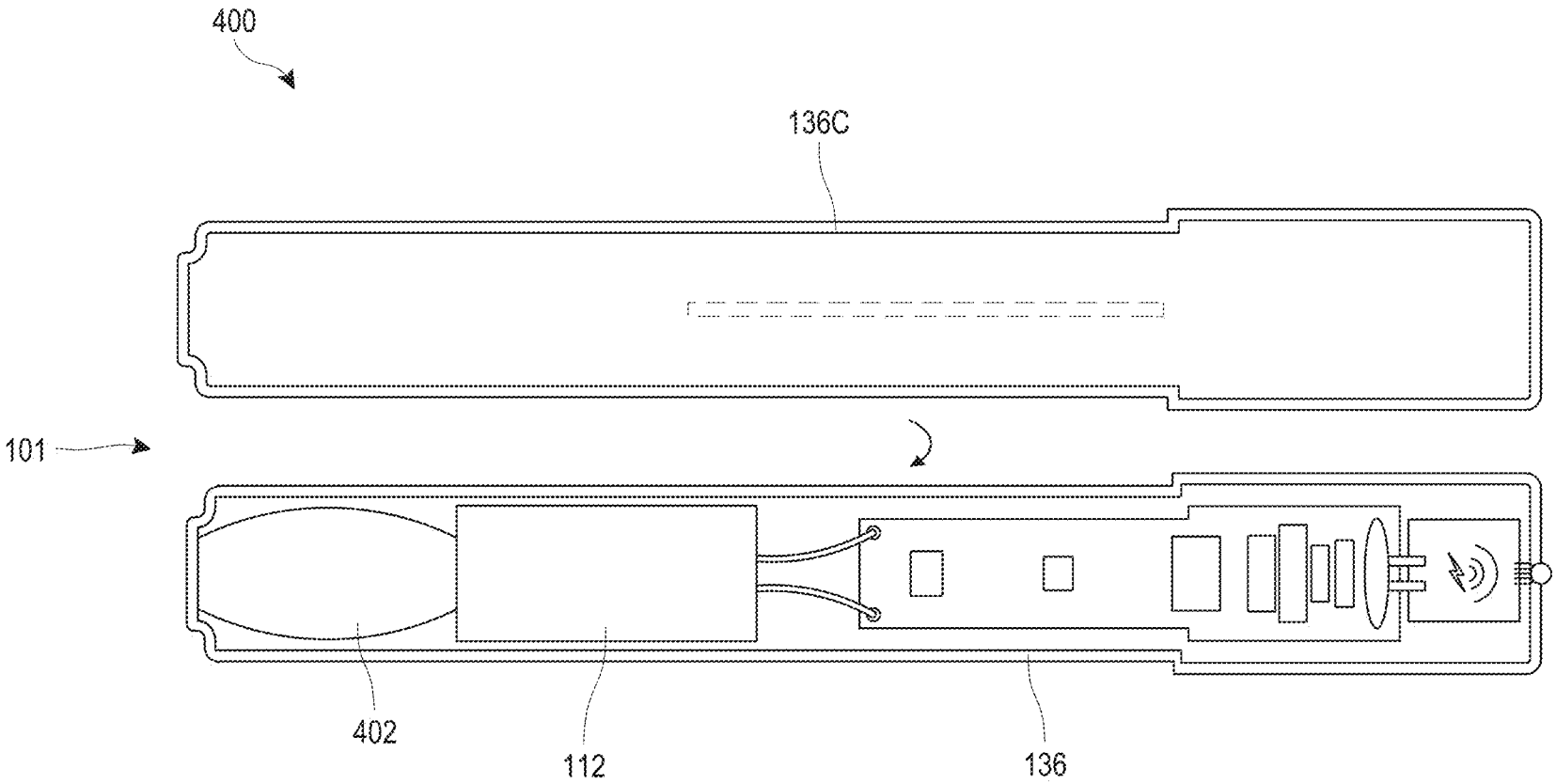
FIG. 2C illustrates an example side view of an embodiment of the sensor system and counterweight with a full sensor housing.

Referring now to FIGS. 2A-C, are a plurality of various sensor housings (e.g., system enclosures) of the sensor system 101 as consistent with one or more embodiments as described herein. The plurality of sensor housings of the sensor system 101 with reference to FIGS. 2A-C may be partially or fully implemented and/or performed by one or more embodiments as described herein.

In some embodiments, the LED 126 protrudes through the sensor housing 136. In some embodiments, the LED 126 abuts the end of the sensor housing 136. In embodiments in which the LED 126 abuts the end of the sensor housing 136 the end material of the sensor housing 136 is light transparent and/or translucent (e.g., a diaphanous plastic).

FIG. 2A illustrates an example side view 200 of an embodiment of the sensor system 101 with a partial sensor housing 136A. The partial sensor housing 136A fully encases the sensor system 101, except the battery 112 which extends past the sensor housing 136A, by mating with the sensor housing 136 to form a partial cylindrical like enclosure. In some embodiments, the battery 112 and partial sensor housing 136A mated with the sensor housing 136 of the sensor system 101 are waterproof and/or water resistant. In some embodiments, the alignment rib 110A is a strip protruding out from the partial sensor housing 136A and/or sensor housing 136. The strip of the alignment rib 110A may vary in length and/or shape as consistent with one or more embodiments as described herein (e.g., the strip may be a cube shape strip, L shape strip, C shape strip, U shape strip, ovoid shape strip, triclinic shape strip, small nub of any of the various described shapes, among other shapes and sizes). The strip of the alignment rib 110A may be cut and/or modified further to a desired shape and/or size based on the size and/or shape of the alignment notch 104 of the shaft 102 of the sport apparatus.

FIG. 2B illustrates an example side view 300 of an embodiment of the sensor system 101 with a full sensor housing 136B. In some embodiments, the sensor housing 1368 fully encases the sensor system 101, including the battery 112, by mating with sensor housing 136 to form a cylindrical like enclosure. In some embodiments, the full sensor housing 136B mated with the sensor housing 136 are waterproof and/or water resistant. Thus, the sensor housings 1368, 136 seal off the sensor system 101 among other electronic components from water.

FIG. 2C illustrates an example side view 400 of an embodiment of the sensor system 101 and counterweight 402 with a full sensor housing 136C. In some embodiments, the full sensor housing 136C fully encases the sensor system 101 and counterweight 402 by mating with sensor housing 136 to form a cylindrical like enclosure. In some embodiments, the sensor housing 136C partially encases the sensor system 101 by mating with sensor housing 136 (e.g., the battery 112 and counterweight 402 may extend outside of the sensor housing 136C and/or sensor housing 136).

In order to produce a more natural and/or stock feeling, the counterweight 402 may be added to the integrated sensor system 101 to change the feel of the sport apparatus. One of ordinary skill in the art may appreciate that such a counterweight system may be especially useful in a sport apparatus in which touch and/or responsiveness of the sport apparatus is critical, such as a putter. In some embodiments, the sensor housings 136, 136C have an adaptation that allows the counterweight 402 to comprise of one or more heavier materials (e.g., tungsten, iron, steel, and/or various alloys thereof). In some embodiments, the heavier materials may be incorporated in an adjustable manner into the sensor housings 136, 136C. In one embodiment, threaded ports (not shown) are in the sensor housings 136, 136C (e.g., at the bottom and/or sides of the sensor housings 136, 136C) and accept one or more counterweights 402 (e.g., tungsten screws and/or fasteners). In another embodiment, one or more counterweights 402 stack inside of the sensor housings 136, 136C below the battery 112 at a desired weight. Alternatively, in some embodiments, the sensor housings 136, 136C may solely be the counterweight 402, in which the sensor housings 136, 136C are made of the heavier materials as described herein or some combination of one or more of the heavier materials and plastic. For example, the plastic portion of the sensor housings 136, 136C may enclose the portion of the integrated sensor system 101 that is outside the shaft 102 (e.g., the portion of the integrated sensor system 101 that is above the alignment rib 110 and/or shoulders 106 so the Bluetooth 122, GPS 120 and/or cellular modem 132 transmission is not impeded), while the heavier metal portion of the sensor housings 136, 136C may enclose the portion of the integrated sensor system 101 that is inside the shaft 102. The amount of added counterweight 402 as consistent with one or more embodiments as described herein may be controlled by proportioning the amount of heavier metals and plastic in the sensor housings 136C, 136.

Exemplary System Alignment

Referring now to FIGS. 3A-D, are a plurality of various alignment systems and methods of the integrated sensor system 101 as consistent with one or more embodiments as described herein. The plurality of alignment systems and methods of the integrated sensor system 101 with reference to FIGS. 1 and 3A-D may be partially or fully implemented and/or performed by one or more embodiments as described herein.

In each of FIGS. 3A-D, the bottom sensor housing (e.g., sensor housing 136) mates with the top sensor housing (e.g., one of sensor housings 136A-C, or other suitable top mating sensor housing) to form the cylindrical like enclosure that is inserted 108 into the shaft 102 of the sport apparatus (e.g., golf club) for alignment thereby restricting rotational movement about the longitudinal axis of the shaft 102. Alignment may be accomplished with one or more mating elements (e.g., fittings) such as notches, holes, ribs, keys, buttons, and/or fasteners as described herein. The alignment may also be accomplished with other types of shafts and/or mating elements.

Figure 3A:
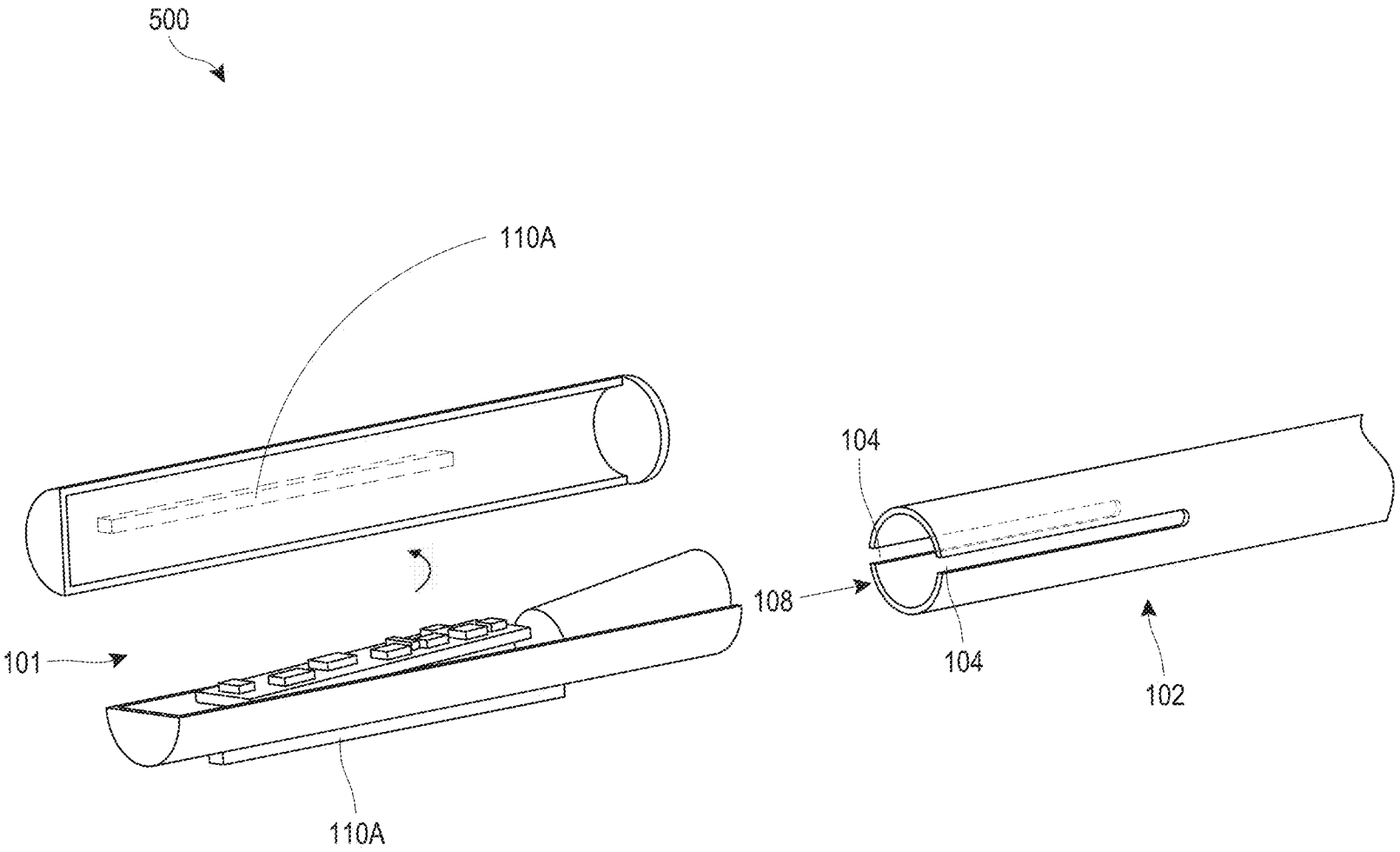
FIG. 3A illustrates an example perspective view of an embodiment of the sensor system with a sensor housing aligned to mate into a shaft via a notch fitting.

FIG. 3A illustrates an example perspective view 500 of an embodiment of the integrated sensor system 101 with sensor housings that are mated and aligned into a shaft 102 via a notch fitting. The notch fitting comprises alignment rib strips 110A which fit into the alignment notches 104A. The alignment rib strips 110A are inserted 108 into the paired alignment notches 104A. In some embodiments the alignment rib strips 110A may be modified and/or cut to a desired length or shape before being inserted 108 into the alignment notches 104A. The alignment rib strips 110A may allow for more variation across a variety of shaft sizes, shapes and lengths of sport apparatus in comparison to an alignment rib 110 as illustrated in FIG. 1.

Figure 3B:
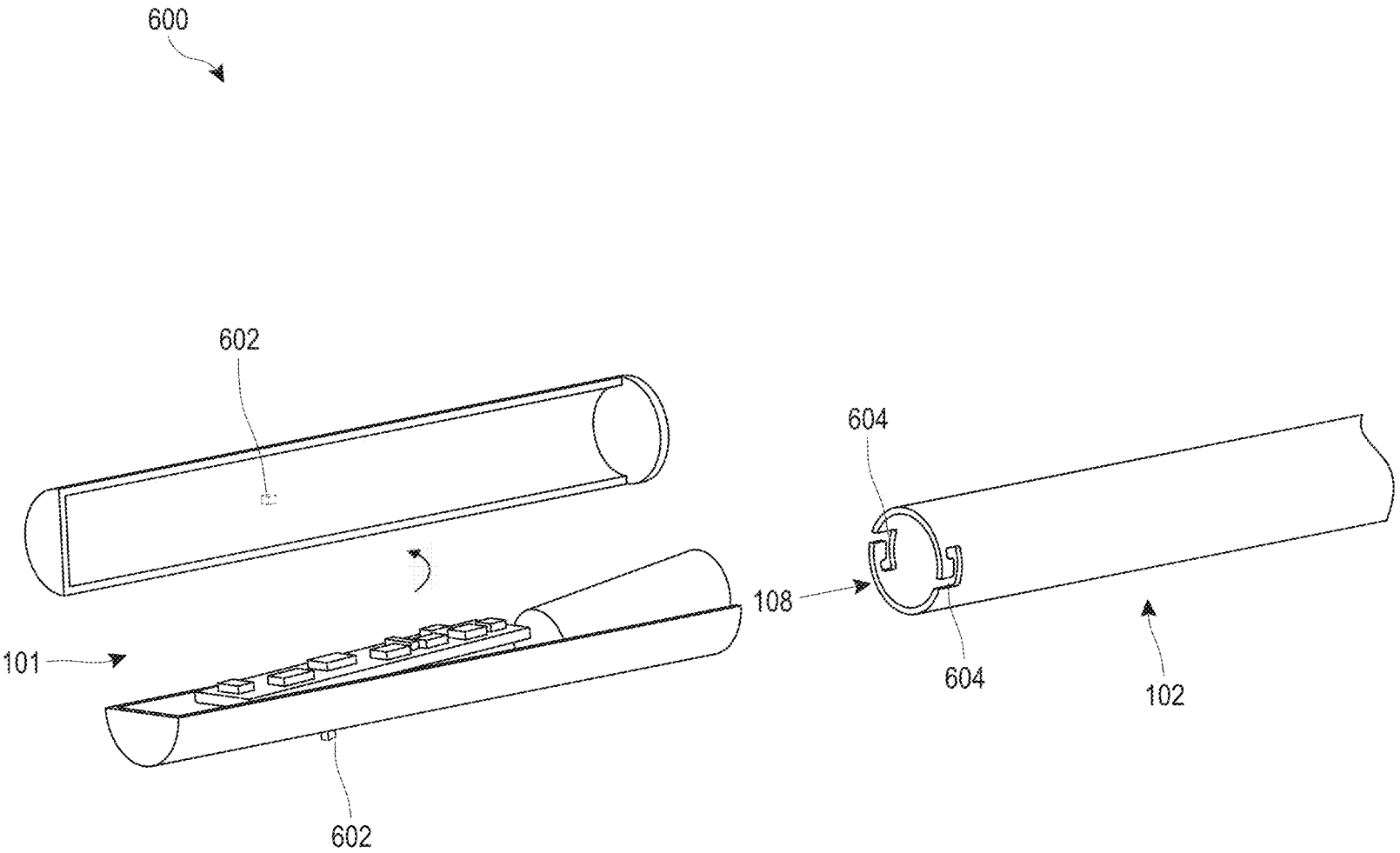
FIG. 3B illustrates an example perspective view of an embodiment of the sensor system with a sensor housing aligned to mate into a shaft via a notch and key fitting.

FIG. 3B illustrates an example perspective view 600 of an embodiment of the integrated sensor system 101 with sensor housings that are mated and aligned into a shaft 102 via a notch and key fitting. In some embodiments, the notch and key fitting comprise alignment rib keys 602 which fit into the alignment notches 604. In some embodiments, the alignment rib keys may be alignment key strips (not shown). For example, an L shaped key strip that fits into an elongated notch. The notch and key fitting allows for a twist and lock style feature.

In some embodiments the alignment rib keys 602 are cube shaped (e.g., cube rib keys 602 illustrated in FIG. 3B), inserted 108 into coordinating alignment notches 604, and twisted upon insertion to lock in the rib keys 602. In some embodiments the alignment rib keys 602 may be "L" shaped, inserted 108 into coordinating alignment notches 604, and twisted upon insertion to lock in the rib keys 602. In some embodiments, the alignment rib key strips may be modified and/or cut to a desired length or shape before being inserted into the elongated alignment notches. The alignment rib key strip may allow for more variation across a variety of shaft sizes, shapes and lengths of sport apparatus.

Figure 3C:
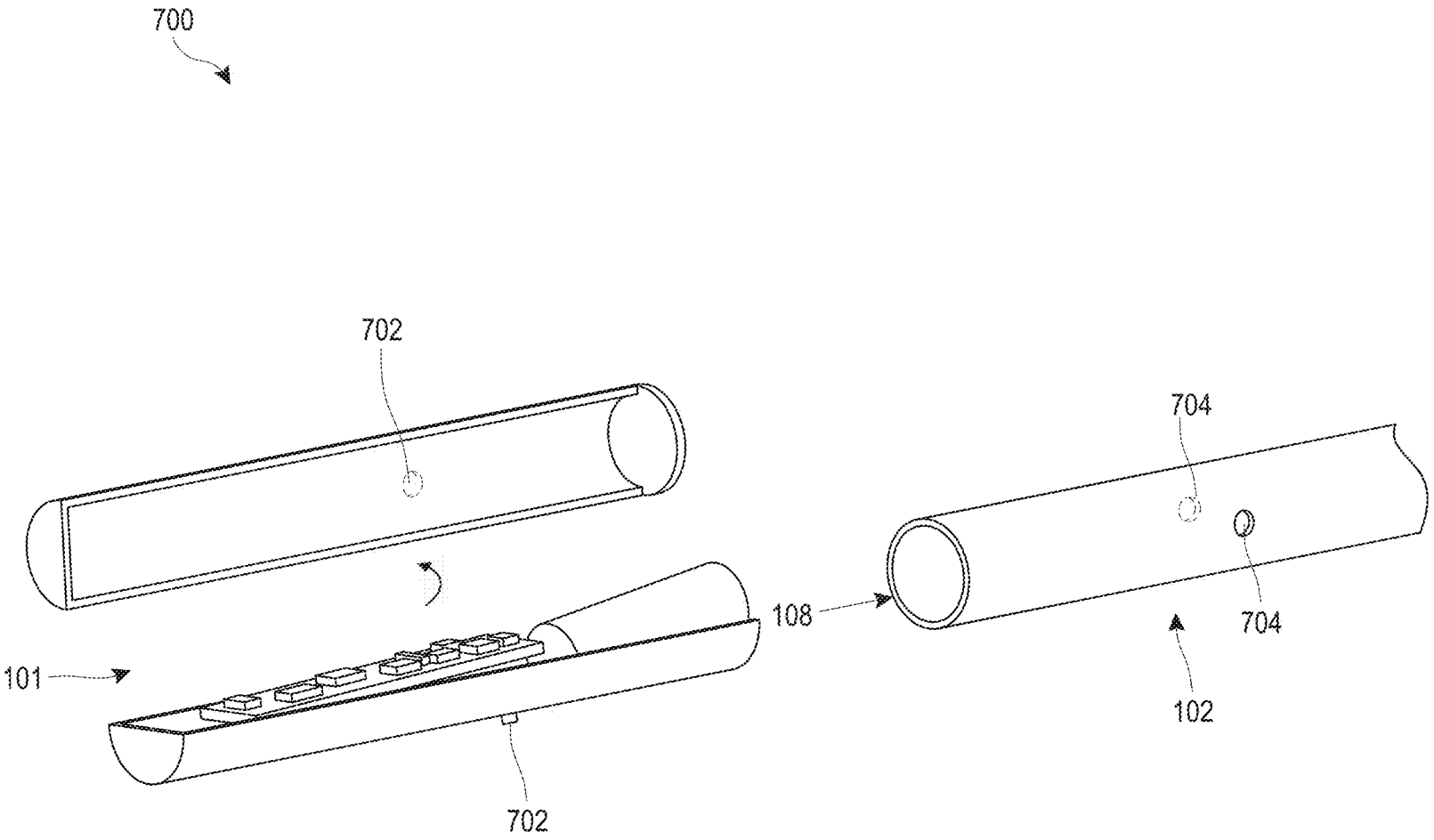
FIG. 3C illustrates an example perspective view of an embodiment of the sensor system with a sensor housing aligned to mate into a shaft via a hole and spring button fitting.

FIG. 3C illustrates an example perspective view 700 of an embodiment of the integrated sensor system 101 with sensor housings that are mated and aligned into a shaft 102 via a hole and spring button fitting. In some embodiments, the spring button fitting comprises domed push spring buttons 702 which fit into the alignment holes 704. On insertion 108 the spring buttons 702 are pushed into the sensor housings of the integrated sensor system 101 such that the spring buttons 702 are flush and/or nearly flush with the sensor housings. Then the sensor housings may fit into the shaft 102 of the sport apparatus. The enclosure is then maneuvered so that the spring buttons 702 meet and extend out of the alignment holes 704 to lock the integrated sensor system 101 in place.

Figure 3D:
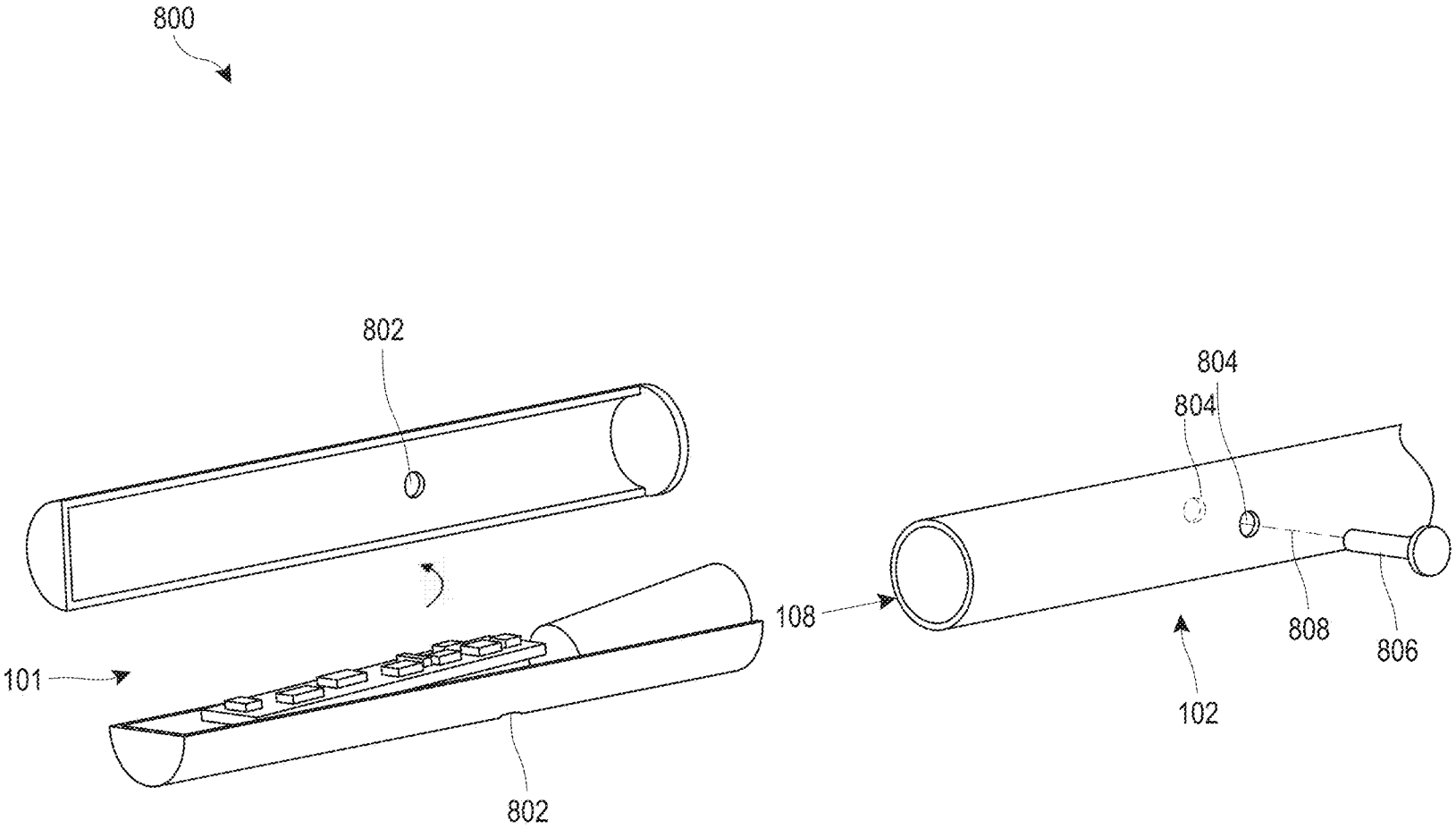
FIG. 3D illustrates an example perspective view of an embodiment of the sensor system with a sensor housing aligned to mate into a shaft via a hole and fastener fitting.

FIG. 3D illustrates an example perspective view 800 of an embodiment of the integrated sensor system 101 with sensor housings that are mated and aligned into a shaft 102 via a hole and fastener fitting. In some embodiments, the fastener fitting comprises fasteners 806 (e.g., screws, pins, rivets, threaded rods, among other fastener types). On insertion 108 the sensor housings are maneuvered so that the fastener 806 meets and extends through 808 the alignment holes 804 of the shaft 102 of the sport apparatus and the alignments holes 802 of the sensor housing to lock the integrated sensor system 101 in place. In some embodiments the alignment holes 804, 802 are threaded. In some embodiments, the fastener 806 extends through 808 only one alignment hole 804 of the shaft and one alignment hole 802 of the sensor housing to lock the integrated sensor system 101 in place. In some embodiments, one fastener 806 extends 808 through one alignment hole 804 of the shaft and one alignment hole 802 of the sensor housing while another fastener (not shown) extends through the other alignment hole 804 of the shaft and the other alignment hole 802 of the sensor housing to lock the integrated sensor system 101 in place.

Exemplary System Integrated in Golf Clubs

Figure 4:
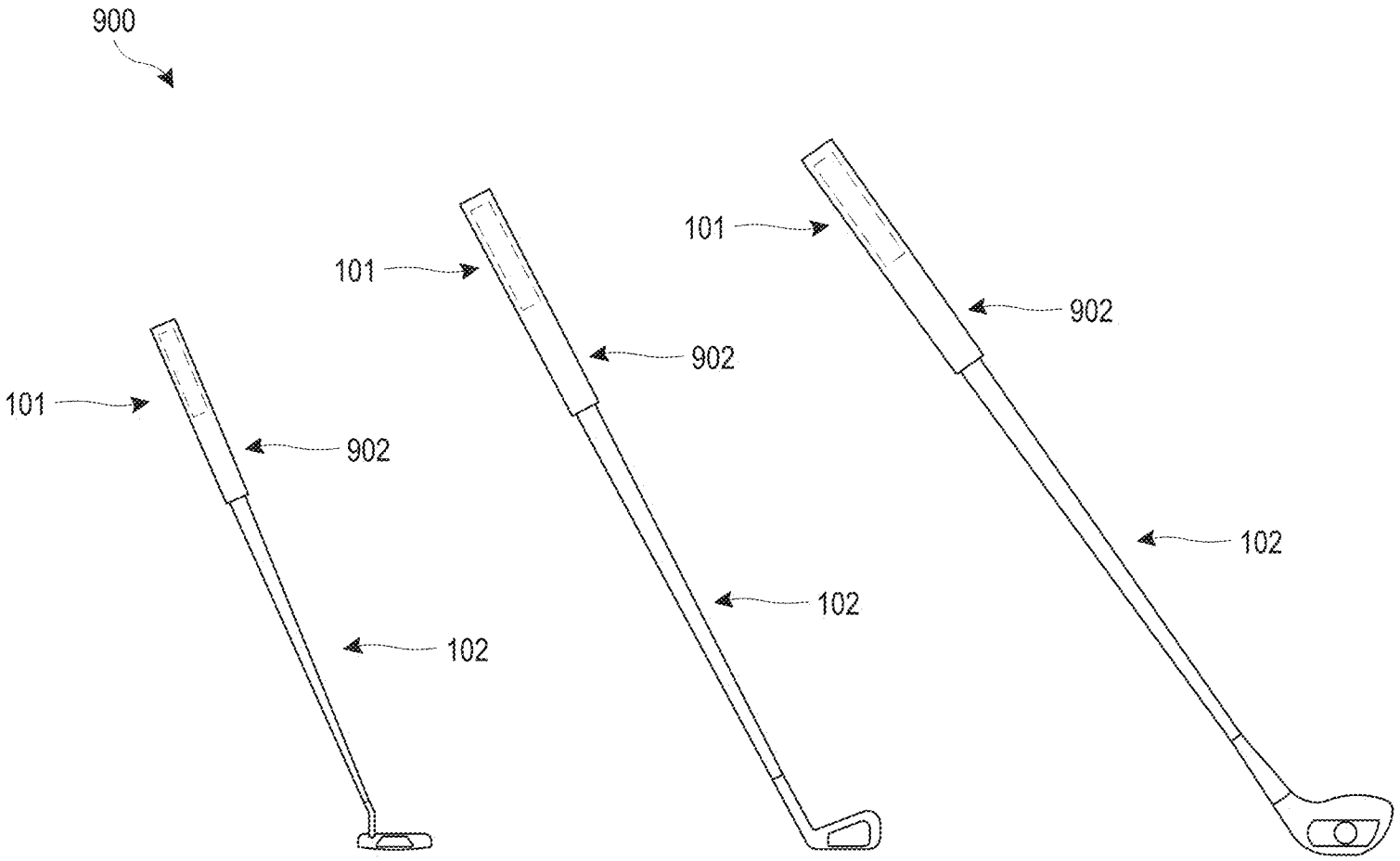
FIG. 4 illustrates an example side view of the integrated sensor system assembled into an example putter, iron, and driver golf club.

Referring now to FIG. 4, illustrates an example front view 900 of the integrated sensor system 101 assembled into an example putter, iron, and driver golf club. A stock grip 902 is slid over the sensor system 101 and the shaft 102 to complete the assembly of each golf club. Though a putter, iron and driver are illustrated as example golf clubs, there are many other golf clubs that may be included without limitation, such as a wedge, hybrid, or fairway wood.

Exemplary System Charging

Figure 5B:
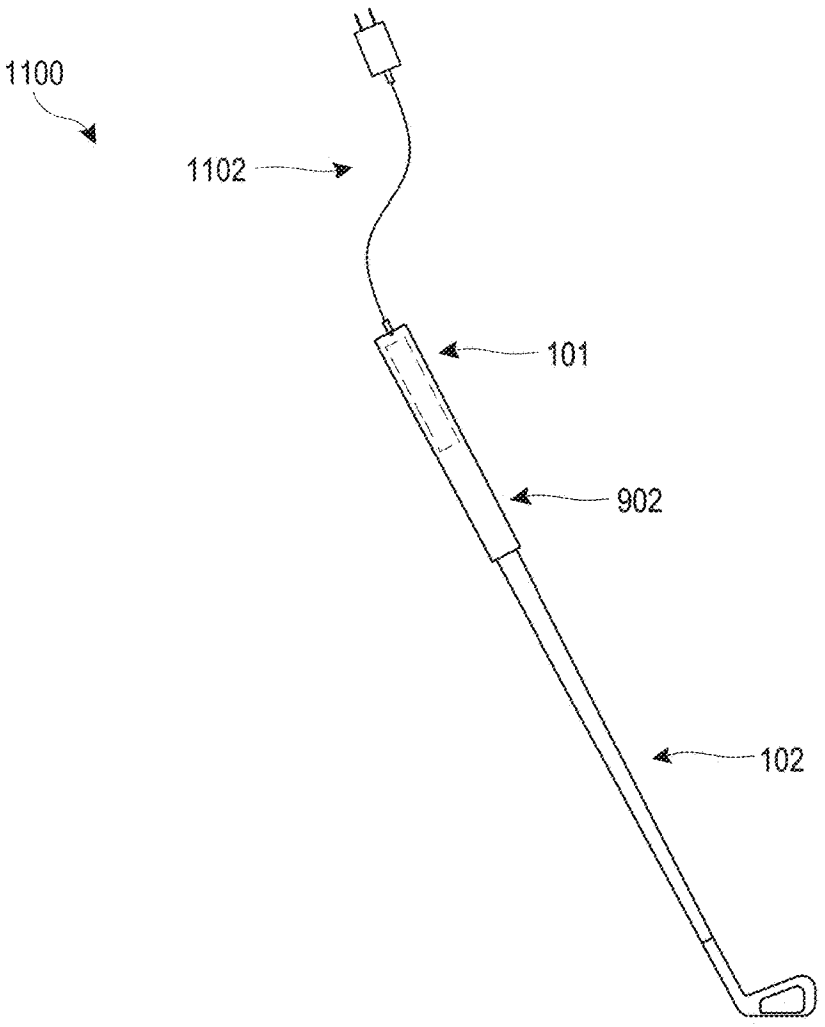
FIG. 5B illustrates an example side view of the integrated sensor system assembled into an example golf club that is charged via a wired charger according to various embodiments of the present disclosure.

Referring now to FIGS. 5A-B, illustrates various systems and methods of charging the integrated sensor systems 101 that are assembled into the golf clubs.

In some embodiments, a plurality of integrated sensor systems 101 are charged at one time via a charging pad (e.g., a plate and/or disk) that contains a plurality of spaced apart (e.g., equally spaced and visually indicated) charging coils. A golf bag 1030 orients the golf clubs comprising the integrated sensor systems 101 such that the charge receiving coils 124 of the integrated sensor systems 101 are aligned correctly with the charge emitting coil of the charging pad. In some embodiments, the charging pad is a separate stand-alone charging pad that the golf bag 1030 rests on. In some embodiments, the golf bag 1030 incorporates the charging pad into the floor portion of the golf bag with an accessible charging connector when charging of the charging pad is desired.

FIG. 5A, illustrates an example perspective view 1000 of the integrated sensor systems 101 assembled into the golf clubs and are wirelessly charging via various charging coils, pads and/or stations. In some embodiments, the integrated sensor systems 101 of the golf clubs wirelessly charge via a charging pad 1002 at the bottom of a golf bag 1030. The charging pad 1002 may be attachable to or a part of the golf bag 1030. In some embodiments, the integrated sensor systems 101 of the golf clubs wirelessly charge via a charging pad 1004 at the bottom golf bag carrying portion of a golf pull or push cart 1010. The charging pad 1004 may be attachable to or a part of the golf pull or push cart 1010. In some embodiments, the charging pad 1004 of the golf pull or push cart 1010 wirelessly charges the charging pad 1002 of the golf bag 1030 and vice versa depending on battery life. In some embodiments, the integrated sensor systems 101 of the golf clubs wirelessly charge via a charging pad 1006 at the golf bag carrying floor portion of a motorized golf cart 1020. The charging pad 1006 may be attachable to or a part of the motorized golf cart 1020. In some embodiments, the charging pad 1006 of the motorized golf cart 1020 wirelessly charges the charging pad 1002 of the golf bag 1030 and vice versa depending on battery life.

FIG. 5B, illustrates an example side view 1100 of the integrated sensor system 101 assembled into a golf club that is charged via a wired charger 1102. In some embodiments, the wired charging 1102 of the rechargeable power source of the integrated sensor system 101 occurs via a charge connector that is beneath the outer surface of the grip 902. In some embodiments, the location of the charge connector is on the top of the grip 902 at or near the drain hole (e.g., the position illustrated in FIG. 5B). In some embodiments, the charge connector is on the side of the grip 902. In some embodiments, the charge connector is covered with a flap of grip material (e.g., a waterproof and/or resistant sealing flap of the golf club grip) which when displaced allows access to the charge port of the integrated sensor system 101 for wired charging. A source of charging current may be supplied by a wire (e.g., wired charger) or other charging device that plugs into the charge connector.

Figure 5C:
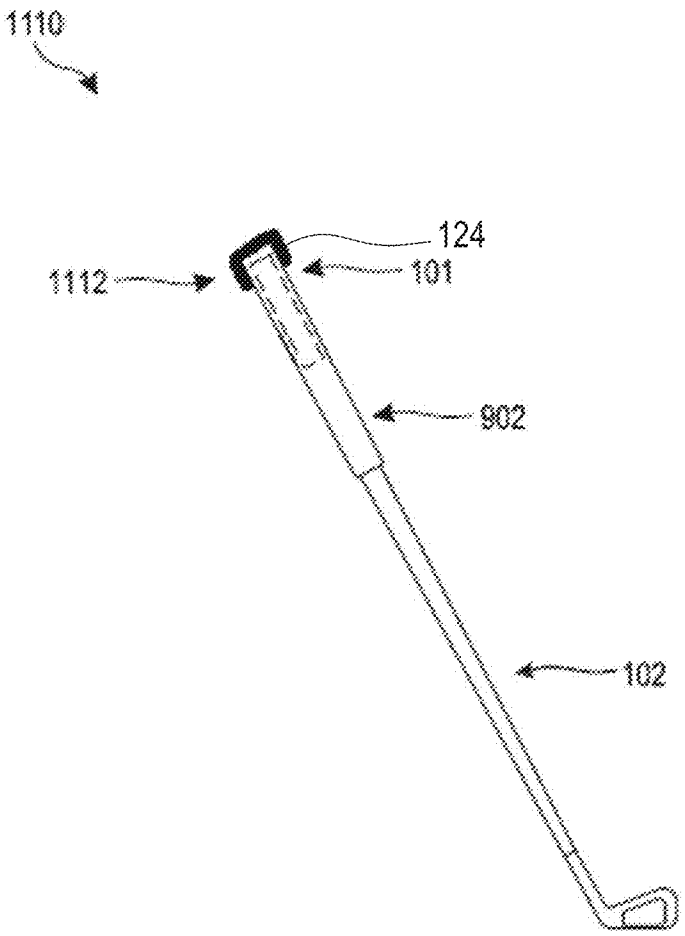
FIG. 5C illustrates an example side view of the integrated sensor system assembled into an example golf club that is charged via a wireless charging cup according to various embodiments of the present disclosure.

FIG. 5C illustrates an example side view 1110 of the integrated sensor system 101 assembled into a golf club that is charged via a wireless charging cup 1112. The wireless charging cup 1112 comprises a powered charge emitting coil that is positioned at the top of the grip 902 of the golf club to wirelessly charge the integrated sensor system 101, where the charge receiving coil 124 of the integrated sensor system 101 is aligned with the charge emitting coil of the wireless charging cup 1112. In some embodiments, the wireless charging cup 1112 is powered via one or more batteries. In some embodiments, the wireless charging cup 1112 is powered via a wired charging cord. In some embodiments, the wireless charging cup is powered via a wireless charging pad. In some embodiments, the wireless charging cup 1112 is a charging ring that slips over the top of the grip 902 of the golf club. In some embodiments, the wireless charging cup is adjustable such that it may securely fit onto standard golf grips and/or custom golf grips (e.g., jumbo putter grips, wrap golf grips, oversized golf grips, among other custom grips).

In some embodiments, the battery 112 of the integrated sensor system 101 may be replaceable rather than rechargeable as the battery 112 is external to the PCB 118 which is contained inside the enclosure. To replace the battery 112, the grip 902 is removed, the integrated sensor system 101 is pulled out of the shaft 102, and the battery 112 is then replaced. The integrated sensor system 101 may then be reinserted 108 into the shaft 102 and a new grip installed over the integrated sensor system 101 and shaft 102.

In some embodiments, an energy harvesting component is a part of the charging system of the integrated sensor system 101 wherein motion of the golf club (e.g., walking, jogging, riding in a golf cart etc. with the golf clubs in the golf bag 1030 or out of the golf bag 1030 e.g., a golf swing)) causes current to be generated and captured in the battery 112.

Exemplary Method of Sensor System Integration

Figure 7A:
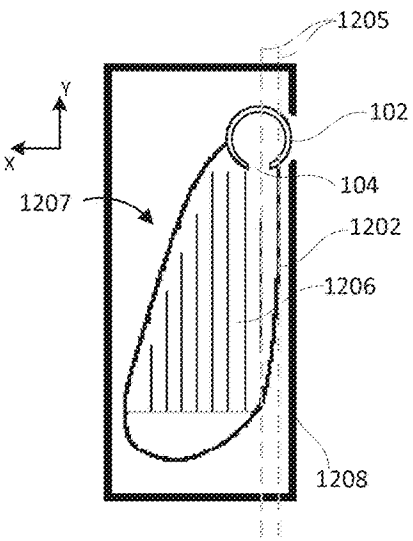
FIG. 7A illustrates an example top down view of a golf club comprising a shaft with a notch fitting, head, club face, and leading edge.
Figure 7B:
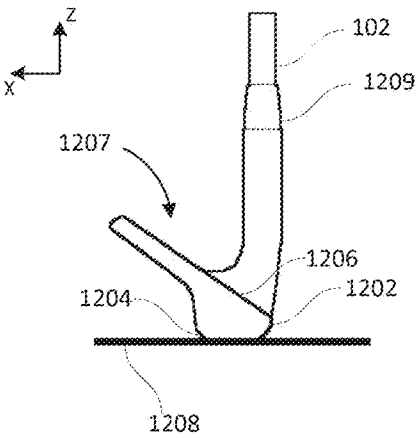
FIG. 7B illustrates an example side view of the golf club comprising the shaft, head, ferrule, club face, leading edge and trailing edge.
Figure 6:
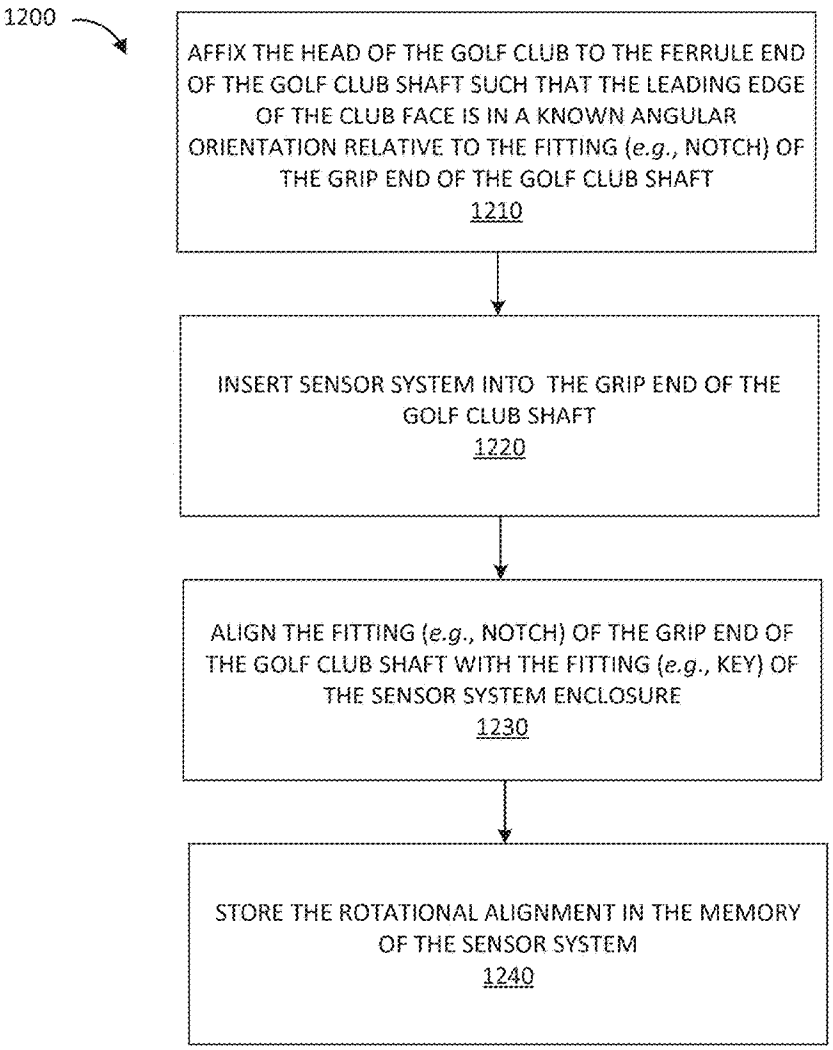
FIG. 6 is an example flowchart for integrating the sensor system.

Referring now to FIG. 6, is an example flowchart 1200 for integrating the sensor system 101 into a golf club. At FIG. 7A an example top down view of a golf club is illustrated depicting a shaft 102 with a notch fitting 104, head 1207, club face 1206, and leading edge 1202 on a plane 1208 to provide further clarity for the flowchart 1200. At FIG. 7B an example side view of the golf club is further illustrated comprising the shaft 102, head 1207, ferrule 1209, club face 1206, leading edge 1202 and trailing edge 1204 on the plane 1208. Although an iron resting on plane 1208 is illustrated in FIGS. 7A-B, this is not intended to be limiting on the scope of the invention. There are many other golf clubs that may be included without limitation, such as a driver, wood, putter, hybrid, and wedge. Additionally, the sensor system 101 may be integrated into the golf club where the golf club is not resting on plane 1208.

In order to integrate the sensor system 101, the three-dimensional coordinate system (e.g., XYZ) of the sensor system 101 should be in a known angular orientation relative to the leading edge 1202 of the club face 1206. The sensors 114 of the sensor system 101 are aligned on the PCB 118 and the PCB 118 is aligned in the enclosure of the sensor system 101. In some embodiments, the sensors 114 of the sensor system 101 are calibrated using known sources of acceleration and rotation prior to assembly of the printed circuit assembly (PCA) into the enclosure. The calibration of the sensors 114 is then stored in the memory (e.g., flash memory) of the sensor system 101. The enclosure of the sensor system 101 should then be aligned to the club face 1206. The alignment may be accomplished by alignment methods and systems of the sensor system 101 with reference to FIGS. 1, 2A-C, and 3A-D. The alignment methods and systems may be partially or fully implemented and/or performed by one or more embodiments as described herein.

Beginning at block 1210, the head 1207 of the golf club is affixed to the ferrule 1209 end of the golf club shaft 102 such that the leading edge 1202 of the club face 1206 is in a known angular orientation relative to the fitting (e.g., notch fitting 104) of the grip end of the golf club shaft 102. Next at block 1220, the sensor system 101 is inserted into the grip end of the club shaft 102. At block 1230 the fitting (e.g., notch fitting 104) of the grip end of the golf club shaft is aligned with the fitting (e.g., alignment rib 110) of the sensor system enclosure.

Thus, when viewing the golf club top down from the grip end of the club shaft 102, the leading edge 1202 of the club face 1206 is rotationally aligned relative to the fitting (e.g., notch, hole, among other fittings) of the club shaft 102 that orients the inserted sensor system 101. In some embodiments, the fixed reference line of the fitting of the club shaft 102 is parallel to the leading edge 1202 of the club face 1206 (e.g., parallel reference lines 1205 as illustrated in FIG. 7A). In some embodiments, the fixed reference line of the fitting of the club shaft 102 is perpendicular to the leading edge 1202 of the club face 1206. Once the club face to club shaft relationship is fixed, the sensor housing is inserted into the club shaft 102 with the fitting of the sensor housing slid into the fitting of the club shaft 102. The actions of blocks 1210, 1220, and 1230 establish a known orientation of the sensor coordinate system relative to the club face 1206. Now at block 1240 the rotational alignment is stored in the memory of the sensor system 101 and the sensor system 101 is successfully integrated. In some embodiments, the loft, lie, and length of the golf club are custom additional inputs to the sensor system 101 at initial setup. In some embodiments, the loft, lie, and length of the golf club are factory default measurements that do not require additional input to the sensor system 101 at initial setup.

While various embodiments of the present invention have been described above, it should be understood that they have been presented by way of example only, and not of limitation. Likewise, the various diagrams may depict an example architectural or other configuration for the invention, which is provided to aid in understanding the features and functionality that can be included in the invention. The invention is not restricted to the illustrated example architectures or configurations, but the desired features can be implemented using a variety of alternative architectures and configurations.

Indeed, it will be apparent to one of skill in the art how alternative functional configurations can be implemented to provide the desired features of the present invention. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Example Implementations

Many variations and modifications may be made to the above-described embodiments, the elements of which are to be understood as being among other acceptable examples. All such modifications and variations are intended to be included herein within the scope of this disclosure. The foregoing description details certain embodiments. It will be appreciated, however, that no matter how detailed the foregoing appears in text, the systems and methods can be practiced in many ways. As is also stated above, it should be noted that the use of particular terminology when describing certain features or aspects of the systems and methods should not be taken to imply that the terminology is being re-defined herein to be restricted to including any specific characteristics of the features or aspects of the systems and methods with which that terminology is associated.

The systems, methods, and devices described herein each have several aspects, no single one of which is solely responsible for its desirable attributes. Without limiting the scope of this disclosure, several non-limiting features will now be discussed briefly. The following paragraphs describe various example implementations of the devices, systems, and methods described herein. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

Example One: A sport apparatus for measuring swing force and swing path of an athlete, the sport apparatus comprising: a sensor system; a shaft, wherein the shaft comprises a first fitting; an enclosure configured to encase the sensor system, wherein the enclosure comprises a second fitting, wherein the second fitting is configured to align and mate with the first fitting, wherein a portion of the enclosure resides within the shaft; and a grip, wherein the grip encases the sensor system and a portion of the shaft.

Example Two: The sport apparatus of Example One, wherein the sensor system comprises one or more magnetic, angular rate, or gravity (MARG) sensors configured to measure the swing force and swing path of the athlete.

Example Three: The sport apparatus of Example Two, wherein the sensor system comprises a barometer configured to determine a proximate distance a sport object travels through air based on the swing force and swing path of the athlete determined by the one or more MARG sensors.

Example Four: The sport apparatus of Example One, wherein the sensor system comprises a global positioning system (GPS) receiver and antenna configured to track a plurality of shots from the sport apparatus.

Example Five: The sport apparatus of Example One, wherein the sensor system comprises an inductive charging coil configured to wirelessly charge the sensor system.

Example Six: The sport apparatus of Example Five, wherein the inductive charging coil is positioned at a first end of the sensor system abutting the grip of the sport apparatus, wherein the first end is positioned away from the shaft of the sport apparatus.

Example Seven: The sport apparatus of Example Six, wherein the sensor system is oriented in a golf bag such that the inductive charging coil of the sensor system is aligned with an inductive charging emitting coil of a charging pad located in a floor portion of the golf bag.

Example Eight: The sport apparatus of Example Six, wherein the sensor system is oriented in a golf bag such that the inductive charging coil of the sensor system is aligned with an inductive charging emitting coil of a charging pad located in a bottom golf bag carrying portion of a golf pull or push cart.

Example Nine: The sport apparatus of Example Six, wherein the sensor system is oriented in a golf bag such that the inductive charging coil of the sensor system is aligned with an inductive charging emitting coil of a charging pad located in a golf bag carrying floor portion of a motorized golf cart.

Example Ten: The sport apparatus of Example One, wherein the first fitting is a notch and the second fitting is an alignment rib, wherein the alignment rib mates with the notch.

Example Eleven: The sport apparatus of Example Ten, wherein the first fitting is the notch and the second fitting is an alignment rib strip, wherein the alignment rib strip mates with the notch.

Example Twelve: The sport apparatus of Example One, wherein the first fitting is a lock and the second fitting is an alignment rib key, wherein the alignment rib key mates with the lock via a twist of the alignment rib key into the lock.

Example Thirteen: The sport apparatus of Example One, wherein the first fitting is a first alignment hole and the second fitting is a spring button, wherein the spring button mates with the first alignment hole.

Example Fourteen: The sport apparatus of Example One, wherein the first fitting is the first alignment hole and the second fitting is a second alignment hole, wherein a fastener mates with the first alignment hole and the second alignment hole.

Example Fifteen: The sport apparatus of Example One, wherein the sensor system comprises one or more counterweights.

Example Sixteen: The sport apparatus of Example One, wherein the sport apparatus is at least one of a golf club, baseball bat, softball bat, cricket bat, billiard cue, polo mallet, hockey stick, lacrosse stick, fishing rod, racquetball racquet, or tennis racket.

Example Seventeen: A method of integrating a sensor system into a golf club for measuring swing force and swing path of an athlete, the method of integrating the sensor system into the golf club comprising: affixing a head of the golf club to a ferrule end of a shaft of the golf club, wherein a leading edge of a club face of the golf club is in a known angular orientation relative to a first fitting of the shaft of the golf club; inserting the sensor system into the shaft of the golf club, wherein a portion of an enclosure of the sensor system resides within the shaft; rotationally aligning the first fitting of the shaft of the golf club with a second fitting of the enclosure of the sensor system to orient the sensor system at a fixed orientation; and storing the rotational alignment in memory of the sensor system.

Example Eighteen: The method of Example Seventeen, wherein one or more sensors of the sensor system are aligned on a PCB of the sensor system.

Example Nineteen: The method of Example Eighteen, wherein the PCB is aligned with the enclosure of the sensor system.

Example Twenty: The method of Example Nineteen, wherein the enclosure of the sensor system is aligned with the face of the golf club.

Example Twenty One: The sport apparatus of Example Six, wherein the inductive charging coil of the sensor system is aligned with an inductive charging emitting coil of a wireless charging cup.

As noted above, implementations of the described examples provided above may include hardware, a method or process, and/or computer software on a computer-accessible medium.

Additional Implementation Considerations

Terms and phrases used herein, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future. Furthermore, the use of plurals can also refer to the singular, including without limitation when a term refers to one or more of a particular item; likewise, the use of a singular term can also include the plural, unless the context dictates otherwise.

The presence of broadening words and phrases such as "one or more," "at least," "but not limited to" or other like phrases in some instances shall not be read to mean that the narrower case is intended or required in instances where such broadening phrases may be absent. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

When a feature or element is herein referred to as being "on" another feature or element, it may be directly on the other feature or element or intervening features and/or elements may also be present. In contrast, when a feature or element is referred to as being "directly on" another feature or element, there may be no intervening features or elements present. It will also be understood that, when a feature or element is referred to as being "connected", "attached" or "coupled" to another feature or element, it may be directly connected, attached or coupled to the other feature or element or intervening features or elements may be present. In contrast, when a feature or element is referred to as being "directly connected", "directly attached" or "directly coupled" to another feature or element, there may be no intervening features or elements present.

Although described or shown with respect to one embodiment, the features and elements so described or shown may apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a", "an" and "the" may be intended to include the plural forms as well, unless the context clearly indicates otherwise. It will be further understood that the terms "comprises" and/or "comprising," when used in this specification, specify the presence of stated features, steps, operations, processes, functions, elements, and/or components, but do not preclude the presence or addition of one or more other features, steps, operations, processes, functions, elements, components, and/or groups thereof. As used herein, the term "and/or" includes any and all combinations of one or more of the associated listed items and may be abbreviated as "/".

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features due to the inverted state. Thus, the term "under" may encompass both an orientation of over and under, depending on the point of reference or orientation. The device may be otherwise oriented (rotated 90 degrees or at other orientations) and the spatially relative descriptors used herein interpreted accordingly. Similarly, the terms "upwardly", "downwardly", "vertical", "horizontal" and the like may be used herein for the purpose of explanation only unless specifically indicated otherwise.

Although the terms "first" and "second" may be used herein to describe various features/elements (including steps or processes), these features/elements should not be limited by these terms as an indication of the order of the features/elements or whether one is primary or more important than the other, unless the context indicates otherwise. These terms may be used to distinguish one feature/element from another feature/element. Thus, a first feature/element discussed could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise.

For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, may represent endpoints or starting points, and ranges for any combination of the data points. For example, if a particular data point "10" and a particular data point "15" may be disclosed, it is understood that greater than, greater than or equal to, less than, less than or equal to, and equal to 10 and 15 may be considered disclosed as well as between 10 and 15. It is also understood that each unit between two particular units may be also disclosed. For example, if 10 and 15 may be disclosed, then 11, 12, 13, and 14 may be also disclosed.

Although various illustrative embodiments have been disclosed, any of a number of changes may be made to various embodiments without departing from the teachings herein. For example, the order in which various described method steps are performed may be changed or reconfigured in different or alternative embodiments, and in other embodiments one or more method steps may be skipped altogether. Optional or desirable features of various device and system embodiments may be included in some embodiments and not in others. Therefore, the foregoing description is provided primarily for the purpose of example and should not be interpreted to limit the scope of the claims and specific embodiments or particular details or features disclosed.

The examples and illustrations included herein show, by way of illustration and not of limitation, specific embodiments in which the disclosed subject matter may be practiced. As mentioned, other embodiments may be utilized and derived therefrom, such that structural and logical substitutions and changes may be made without departing from the scope of this disclosure. Such embodiments of the disclosed subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve an intended, practical or disclosed purpose, whether explicitly stated or implied, may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The disclosed subject matter has been provided here with reference to one or more features or embodiments. Those skilled in the art will recognize and appreciate that, despite of the detailed nature of the example embodiments provided here, changes and modifications may be applied to said embodiments without limiting or departing from the generally intended scope. These and various other adaptations and combinations of the embodiments provided here are within the scope of the disclosed subject matter as defined by the disclosed elements and features and their full set of equivalents.

What is claimed is:

1. A sport apparatus comprising: a sensor system comprising a three-dimensional coordinate system; a shaft, wherein the shaft comprises a first fitting; a club face of a golf club connected to the shaft so that a leading edge of the club face is in a known angular orientation relative to the first fitting; an enclosure configured to encase the sensor system, wherein the enclosure comprises a second fitting, wherein the second fitting is configured to align and mate with the first fitting so that a three dimensional coordinate system of the sensor system is aligned to the known angular orientation relative to the leading edge of the club face, wherein a rotational alignment of the sensor system relative to the first fitting is stored in a memory of the sensor system, wherein a portion of the enclosure resides within the shaft and an outer portion of the enclosure resides outside the shaft, and wherein the outer portion comprises a Bluetooth radio, and inductive charging coil; and a grip, wherein the grip encases the sensor system and a portion of the shaft.

2. The sport apparatus of claim 1, wherein the sensor system comprises one or more magnetic, angular rate, or gravity.

3. The sport apparatus of claim 1, wherein the sensor system comprises a global positioning system (GPS) receiver and antenna in the outer portion.

4. The sport apparatus of claim 1, wherein the inductive charging coil is configured to wirelessly charge the sensor system.

5. The sport apparatus of claim 4, wherein the inductive charging coil is positioned at a first end of the sensor system abutting the grip of the sport apparatus.

6. The sport apparatus of claim 5, wherein the sensor system is oriented in a golf bag such that the inductive charging coil of the sensor system is aligned with an inductive charging emitting coil of a charging pad located in a floor portion of the golf bag.

7. The sport apparatus of claim 5, wherein the sensor system is oriented in a golf bag such that the inductive charging coil of the sensor system is aligned with an inductive charging emitting coil of a charging pad located in a bottom golf bag carrying portion of a golf pull or push cart.

8. The sport apparatus of claim 5, wherein the sensor system is oriented in a golf bag such that the inductive charging coil of the sensor system is aligned with an inductive charging emitting coil of a charging pad located in a golf bag carrying floor portion of a motorized golf cart.

9. The sport apparatus of claim 5, wherein the inductive charging coil of the sensor system is aligned with an inductive charging emitting coil of a wireless charging cup.

10. The sport apparatus of claim 1, wherein the first fitting is a notch and the second fitting is an alignment rib, wherein the alignment rib mates with the notch.

11. The sport apparatus of claim 10, wherein the first fitting is the notch and the alignment rib is an alignment rib strip, wherein the alignment rib strip mates with the notch.

12. The sport apparatus of claim 1, wherein the first fitting is a lock and the second fitting is an alignment rib key, wherein the alignment rib key mates with the lock via a twist of the alignment rib key into the lock.

13. The sport apparatus of claim 1, wherein the first fitting is a first alignment hole and the second fitting is a spring button, wherein the spring button mates with the first alignment hole.

14. The sport apparatus of claim 13, further comprising a second alignment hole wherein the spring button is capable of mating with the first alignment hole or the second alignment hole.

15. The sport apparatus of claim 1, wherein the sensor system comprises one or more counterweights.

16. The sport apparatus of claim 1, wherein the first fitting comprises a fixed reference line and the leading edge of the club face is parallel to the fixed reference line.

17. The sport apparatus of claim 1, wherein the first fitting comprises a fixed reference line and the leading edge of the club face is perpendicular to the fixed reference line.

18. The sport apparatus of claim 1, wherein a loft, lie, and length of the golf club are set as default measurements in the sensor system.

* * * * *